US011752513B2

(12) United States Patent
Goettke

(10) Patent No.: US 11,752,513 B2
(45) Date of Patent: Sep. 12, 2023

(54) ADAPTER PART, DISPENSER, AND STORAGE CHAMBER FOR USE IN A DISPENSER

(71) Applicant: RPC Bramlage GmbH, Lohne (DE)

(72) Inventor: Sabine Goettke, Lohne (DE)

(73) Assignee: RPC BRAMLAGE GMBH, Lohne (DE)

( * ) Notice: Subject to any disclaimer, the term of this patent is extended or adjusted under 35 U.S.C. 154(b) by 0 days.

(21) Appl. No.: 17/423,234

(22) PCT Filed: Jan. 15, 2020

(86) PCT No.: PCT/EP2020/050908

§ 371 (c)(1),
(2) Date: Jul. 15, 2021

(87) PCT Pub. No.: WO2020/148332

PCT Pub. Date: Jul. 23, 2020

(65) Prior Publication Data

US 2022/0062929 A1 Mar. 3, 2022

(30) Foreign Application Priority Data

Jan. 18, 2019 (GB) ..... 1900718

(51) Int. Cl.
*B05B 11/00* (2023.01)
*B05B 11/02* (2023.01)
*B05B 11/10* (2023.01)

(52) U.S. Cl.
CPC ..... *B05B 11/026* (2023.01); *B05B 11/0054* (2013.01); *B05B 11/1008* (2023.01); *B05B 11/1047* (2023.01); *B05B 11/1059* (2023.01)

(58) Field of Classification Search
CPC ..... B05B 11/0042; B05B 11/0054; B05B 11/3008; B05B 11/3047; B05B 11/3059
See application file for complete search history.

(56) References Cited

U.S. PATENT DOCUMENTS 5,305,921 A 4/1994 Kock et al.
10,092,921 B2 10/2018 Muller
(Continued)

FOREIGN PATENT DOCUMENTS

DE 10 2013 209 997 A1 11/2014
DE 10 2016 106 636 A1 10/2017
(Continued)

OTHER PUBLICATIONS

International Search Report of PCT/EP2020/050908, dated May 4, 2020.

*Primary Examiner* — Vishal Pancholi
(74) *Attorney, Agent, or Firm* — Collard & Roe, P.C.

(57) ABSTRACT

A dispenser for dispensing a liquid or pasty compound that has a dispenser head which has a dispenser opening and a dispenser lower part, a storage chamber, and a pump device in the dispenser head. The compound can be dispensed out of the storage chamber via the dispenser opening by the pump device. The storage chamber is additionally produced as a bag-like storage chamber part and is received in the dispenser lower pat in a replaceable manner. The storage chamber part has an adapter part for interacting with the pump device in order to conduct the compound, and the adapter part has a cover element which can be acted upon in order to form an opening of the storage chamber. A seal wall which extends so as to surround the cover element is suitable for sealingly interacting with the dispenser.

3 Claims, 14 Drawing Sheets

(56) References Cited

U.S. PATENT DOCUMENTS

| | | | |
|---|---|---|---|
| 11,027,297 | B2 | 6/2021 | Pouliaude |
| 2021/0129165 | A1 | 5/2021 | Boulais |

FOREIGN PATENT DOCUMENTS

| | | | |
|---|---|---|---|
| FR | 3 016 618 | A1 | 7/2015 |
| WO | 97/27121 | A1 | 7/1997 |
| WO | 2008/030623 | A2 | 3/2008 |
| WO | 2018/002490 | A1 | 1/2018 |
| WO | 2018/138231 | A1 | 8/2018 |

1
3
52
10
x
6
Sp
55
50
15
12
13
P
46
55
51
9
53
8
54
7
49
44
19
45
20
41
14
48
47
43
42
23
31
21
30
22
26
31
24
18
25
f
g
e
40
39
33
34
35
11
b
a
d
s
4
28
5
16
2
37
c
38
17
t
x
29

Fig. 16
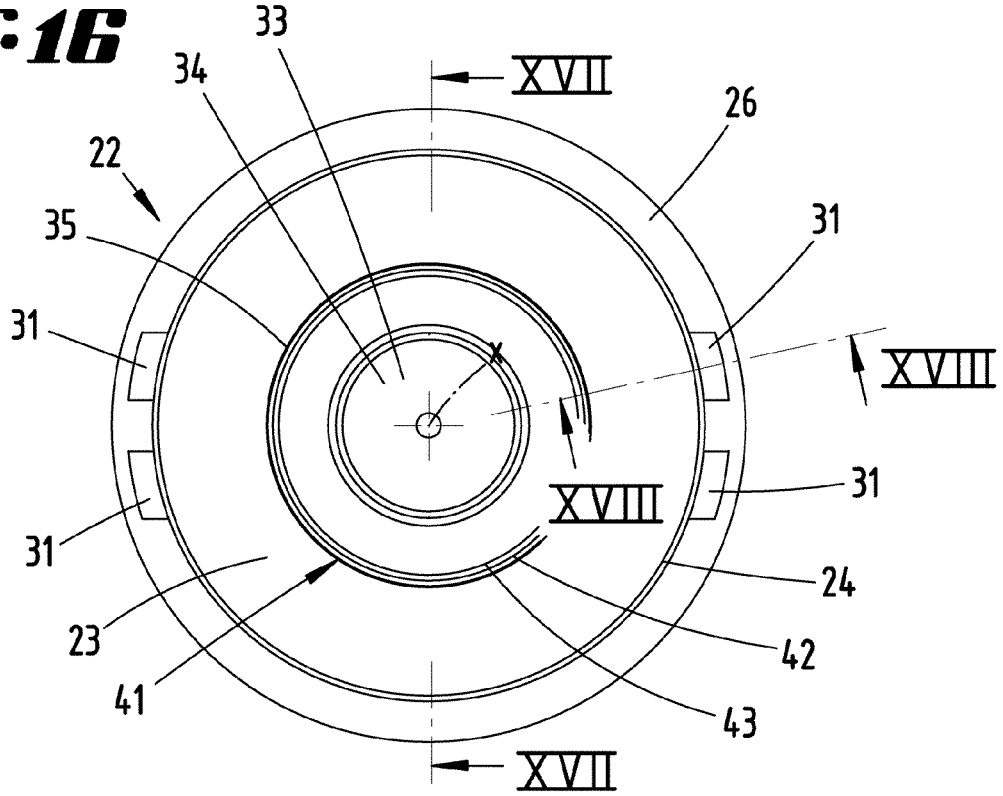
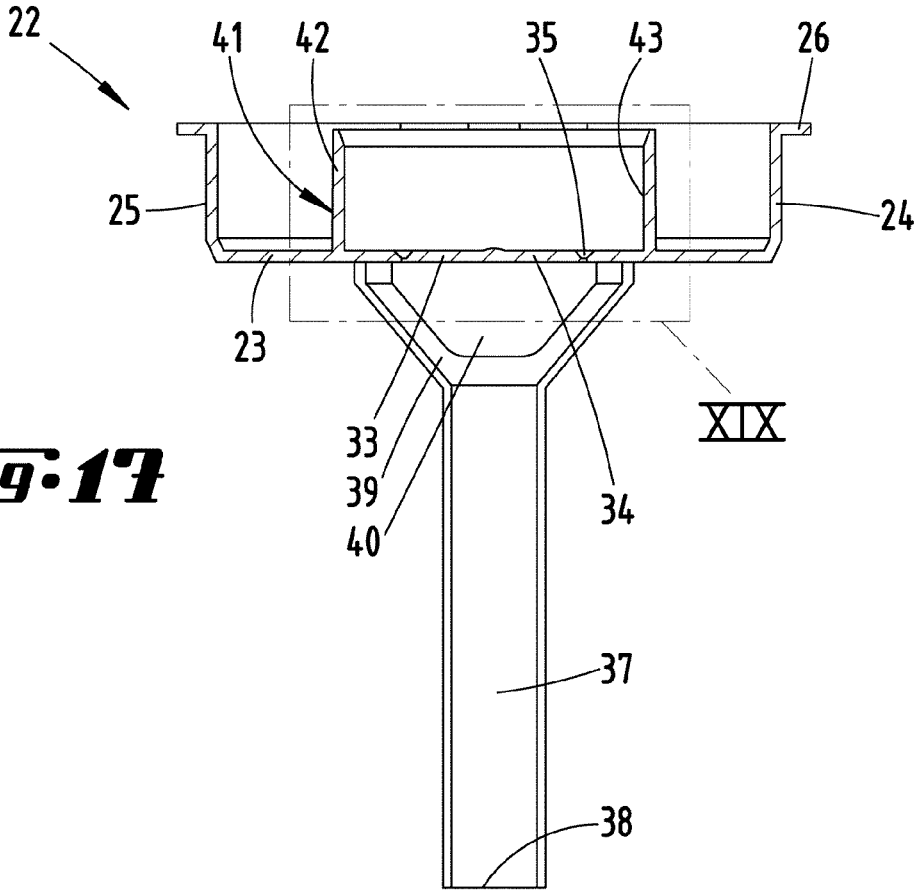
Fig. 17

ADAPTER PART, DISPENSER, AND STORAGE CHAMBER FOR USE IN A DISPENSER

CROSS REFERENCE TO RELATED APPLICATIONS

This application is the National Stage of PCT/EP2020/050908 filed on Jan. 15, 2020 which claims priority under 35 U.S.C. § 119 of British Application No. 1900718.6 filed on Jan. 18, 2019, the disclosure of which is incorporated by reference. The international application under PCT article 21(2) was not published in English.

AREA OF TECHNOLOGY

The invention initially relates to an adapter part that can be arranged in a passage to a storage chamber of a dispenser.

The invention further relates to a dispenser for dispensing a liquid or pasty compound, with a dispenser head having a dispenser opening and a dispenser lower part, a storage chamber and a pump device in the dispenser head, wherein the compound can be dispensed out of the storage chamber via the dispenser opening by means of the pump device, wherein the storage chamber is further designed as a baglike storage chamber part, and received in the dispenser lower part in a replaceable manner, wherein the storage chamber part additionally has an adapter part for interacting with the pump device in order to conduct the compound, wherein the adapter part further has a cover element, which can be acted upon in order to form an opening of the storage chamber.

In addition, the invention relates to a storage chamber designed as a baglike storage chamber part for use in a dispenser for dispensing a liquid or pasty compound, wherein the storage chamber has an adapter part with a cover element, which can be acted upon in order to form an opening of the storage chamber, and wherein a seal collar with a seal surface is formed on the adapter part.

PRIOR ART

For example, dispensers of the kind in question are used for the dispensing, if necessary portioned dispensing, e.g., of creams, and further for example moisturizing cream or toothpaste, or further for the dispensing of lotions, for example. A portioned dispensing can here be achieved by a pumping motion of the dispensing head, wherein the dispensing action successively empties the baglike storage chamber part, in particular while siphoning the compound out of the storage chamber part. The storage chamber part can here be designed as a replaceable refill part, for example, which for purposes of use can be arranged on the dispenser head and received in the dispenser lower part. To this end, the storage chamber part can have an adapter part for directly interacting with the dispenser head, wherein a seal is provided in the interaction area. Before using the storage chamber part for the first time, its storage chamber opening is sealed by a cover element, which is acted upon when the storage chamber part is first placed on the dispenser head or when the dispenser head is exposed to a first pumping action to release the opening.

For example, such a dispenser with a replaceable storage chamber part is known from U.S. Pat. No. 5,305,921 A. The cover element is there designed like a film, which is torn off manually by the user before the storage chamber part is placed on the dispenser head. The cover element extends on the side of a seal collar that is only exposed when the film is removed. The storage chamber part is held on the dispenser via an adapter part.

SUMMARY OF THE INVENTION

In view of the prior art described above, the object of the invention is to improve an adapter part as well as a dispenser and a replaceable storage chamber of the kind in question, in particular in terms of handling.

According to a first inventive idea, one possible solution is provided by an adapter part, wherein emphasis is placed on a cover element which can be acted upon in order to form an opening, wherein a seal wall that extends so as to surround the cover element and is suitable for interacting with the dispenser in a sealing manner is provided.

The object can also be achieved for a dispenser by virtue of the pump device having an opening means on the storage chamber side for automatically acting on the cover element in order to form the opening when the storage chamber part is being placed on the dispenser head.

With respect to the storage chamber, one possible solution to the object according to another inventive idea can involve having the seal collar run so as to surround the cover element in the form of a closed circumferential cylindrical seal wall.

The proposed configuration results in an advantageous configuration in terms of handling both with respect to the adapter part and dispenser as a whole, as well as with respect to the replaceable storage chamber. The opening means provided on the dispenser side causes the storage chamber to open automatically already while placing the storage chamber part on the dispenser head via the adapter part. The opening means here acts on the cover element of the storage chamber or the adapter part in such a way that the opening that is covered and sealed by the cover element before the storage chamber part is used for the first time is preferably permanently released to the inside of the storage chamber, so that the dispenser can be activated to dispense compound through the opening and via the pump device. Accordingly, the user preferably does not have to perform any manual action other than placing the storage chamber part on the dispenser so as to release the described opening.

The cover element can be acted upon via the opening means solely and exclusively when placing the storage chamber part on the dispenser head. In this regard, the opening means has a durable effect on the cover element, further preferably up until the storage chamber part is removed from the dispenser head, for example such that the opening means loads the cover element in a position that releases the opening. The opening means can also be used to completely remove the cover element from the area of the opening.

The seal collar of the adapter part is preferably designed as a circumferential cylindrical seal wall and surrounds the cover element, and is preferably exposed in the area of the dispenser head prior to the cover element being acted upon so as to release the opening in order to preferably interact with a counter seal surface. This yields in particular the handling-related advantage, in which a seal between the storage chamber and dispenser head can initially be achieved when placing the storage chamber part on the dispenser head, in particular on the pump device, before the opening is released via the opening means by acting upon the cover element. In particular in a proposed baglike storage chamber part, the disadvantage to the known prior art is that, in particular when placing the storage chamber part on the dispenser head after previously having released the opening of the storage chamber, compound can exit from the storage chamber in an uncontrolled manner even before producing a sealed passage from the storage chamber to the pump device due to the pressure exerted on the baglike storage chamber by the user in this type of handling process. The configuration according to the invention effectively counters this disadvantage.

Only one (numeric word) opening means can be provided on the dispenser head side or on the side of the pump device, but a plurality of opening means, for example, two, three, four, five or more, for example as many as seven or eight or more, opening means can also be provided, if necessary.

Additional features of the invention are often described below, to include in the description to the figures, in their preferred allocation to the subject matter of claim 1 and/or the additional independent claim(s), or to features of additional claims. However, they can also be important as allocated to only individual features of claim 1 and/or the additional independent claim(s) or the respective additional claim, or each independently.

The storage chamber part or adapter part can have a seal collar to establish a sealed connection to the pump device. In one possible embodiment, the seal collar can here further have a seal surface, which essentially extends in an attachment direction of the storage chamber part on the pump device. As also preferred, the attachment direction can here be given in the extension direction of a central body axis of the dispenser. The attachment direction can further essentially coincide with a movement direction of the pump device while activating the dispenser. A circumferential circular cylindrical seal surface can also arise with respect to the opening of the storage chamber and/or with respect to the body axis of the dispenser.

In another embodiment, the storage chamber part can be attached to the pump device during a screwing motion. To this end, in particular the adapter part can have a screw thread for preferred interaction with a mating thread in the area of the pump device.

According to one possible embodiment, the storage chamber part can further be accommodated in the dispenser lower part. To this end, the dispenser lower part can have a pot-like design, for example. In the usual position of use of the dispenser, the dispenser lower part protectively surrounds the baglike storage chamber part.

In addition, the dispenser lower part can have a thread formation for interacting with the dispenser head. Accordingly, the dispenser lower part can be unscrewed from the dispenser head or screwed to the latter in order to release or receive the storage chamber part.

The storage chamber part is preferably received in the dispenser lower part secured against rotation. To this end, the storage chamber part, for example in the area of the adapter part, can have a recess or a projection, which interacts with a projection or a recess of the dispenser lower part so as to inhibit rotation. On the one hand, this makes it possible to ensure a defined alignment of the storage chamber part. In addition, this nonrotatable arrangement of the storage chamber part in the dispenser lower part yields advantages when placing the dispenser lower part on the dispenser head in order to dock the storage chamber part to the pump device, and concurrently acting on the cover element via the opening means in order to form the opening.

In order to give the storage chamber part a baglike design, the adapter part can be connected with a film bag for receiving the compound. As also preferred, the adapter part can here be manufactured as a plastic injection molded part, correspondingly preferred as a hard plastic part. As preferred, the film bag can also be a plastic bag, which further can be manufactured in a blow molding process, for example. Such a film bag can also be manufactured by cutting tube goods to length and fabricating a bag floor via welding. In another alternative embodiment, the film bag can be shaped like a bellows.

In order to connect the film bag to the adapter part, the adapter part can have a cylinder section. Its outer cylinder surface can be connected with an edge area of the film bag, for example through welding or adhesive bonding.

In another possible embodiment, the outer cylinder surface of the cylinder section can transition into a cylinder floor that runs at essentially a right angle to the outer cylinder surface. In a further embodiment, this cylinder floor can have the opening that is covered or sealed by the cover element prior to a first use. In addition, the cover element can also be formed in the area of the cylinder floor or as a partial section of the cylinder floor.

In the allocation and use position of the dispenser, at a given vertical alignment of the dispenser body axis, the cylinder floor preferably extends aligned along a horizontal plane, further preferably aligned transverse to the attachment direction of the storage chamber part to the pump device and/or preferably aligned transverse to the movement direction of the pump device during a dispenser activation.

On the cylinder floor, the seal surface can adjoin the seal surface running essentially at a right angle to the cylinder floor, and further preferably be outwardly directed relative to the storage chamber. As a consequence, the seal surface is upstream from the cover element and the opening in the attachment direction when attaching the storage chamber part to the pump device or to the dispenser head.

In another embodiment, a holding-open part provided for protruding into the storage chamber can be secured to the adapter part. The latter can be designed as one piece and materially uniform with the adapter part, in particular with the cylinder floor and the cylinder section. The holding-open part can here protrude rodlike from an underside of the adapter part lying opposite the cylinder section, and enter into the stocked compound, so as to prevent a lock-like abutment between the film bag wall when successively dispensing the compound.

The cover element can be designed as a film, for example as a plastic film. This film can be fastened on the edge side of the opening in order to seal the opening of the storage chamber, for example via welding or adhesive bonding. Also possible in this regard is a one-piece and materially uniform design with the adapter part, in particular with its cylinder floor.

In an alternative embodiment, the cover element can be formed by a plate part that has a circumferential weakened area. As also preferred, such a plate part can be manufactured as one piece and materially uniform with the adapter part, further for example during a plastic injection molding process. The weakened area, which is possibly completely circumferential, but alternatively only circumferential over a partial periphery, for example over 180 to 270 degrees or more up to 360 degrees, can be formed by a thinning of the floor area of the adapter part that surrounds the cover element. This thinning can further yield a film hinge-type attachment of the cover element to the surrounding area, for example the cylinder floor, of the adapter part. In any event, this results in a desired tear line, along which the cover element is torn away from the surrounding area if the cover element and/or the weakened area is exposed to a corresponding load. The corresponding load can be achieved via the opening means described at the outset.

In the use position, the torn weakened area comprises at least a partial section of the edge that circumferentially borders the opening.

Accordingly, the opening means of the dispenser head or the pump device interacts with the weakened area of the plate part or with the film, preferably in a destructive manner. The film or plate part, i.e., correspondingly the cover element as such, forms a seal of the storage chamber in the undestroyed position. This seal position cannot be achieved again after exposure to a load via the opening means and the concurrent destruction of the weakened area or the film.

All parts of the dispenser, including the replaceable storage chamber part, can be formed out of a thermoplastic material (polyolefins), for example polyethylene (PE) or polypropylene (PP).

In terms of their disclosure, the areas or value ranges or multiple ranges indicated above and below also include all intermediate values, in particular 1/10 increments of the respective dimension, so if necessary also dimensionless. For example, the indication 0.3- to 0.5-times also includes the disclosure of 0.31- to 0.5-times, 0.3- to 0.49-times, 0.31- to 0.49-times, etc., the disclosure of 300 to 340 degrees also includes the disclosure of 300.1 to 340 degrees, 300 to 339.9 degrees, 300.1 to 339.9 degrees, etc. This disclosure can serve to delimit a mentioned range boundary from below and/or above on the one hand, but alternatively or additionally to disclose one or several singular values from a respectively indicated range.

BRIEF DESCRIPTION OF THE DRAWINGS

The invention is described below based on the attached drawing, but it only represents an exemplary embodiment. The drawing shows:

FIG. 16 a top view of the adapter part;

FIG. 17 the section according to line XVII-XVII on FIG. 16;

DESCRIPTION OF THE EMBODIMENTS

Shown and described initially in relation to FIGS. 1 to 6 is a dispenser 1 for dispensing flowable, for example liquid or pasty, compounds 2, further for example for dispensing creams or lotion, for example.

Figure 1:
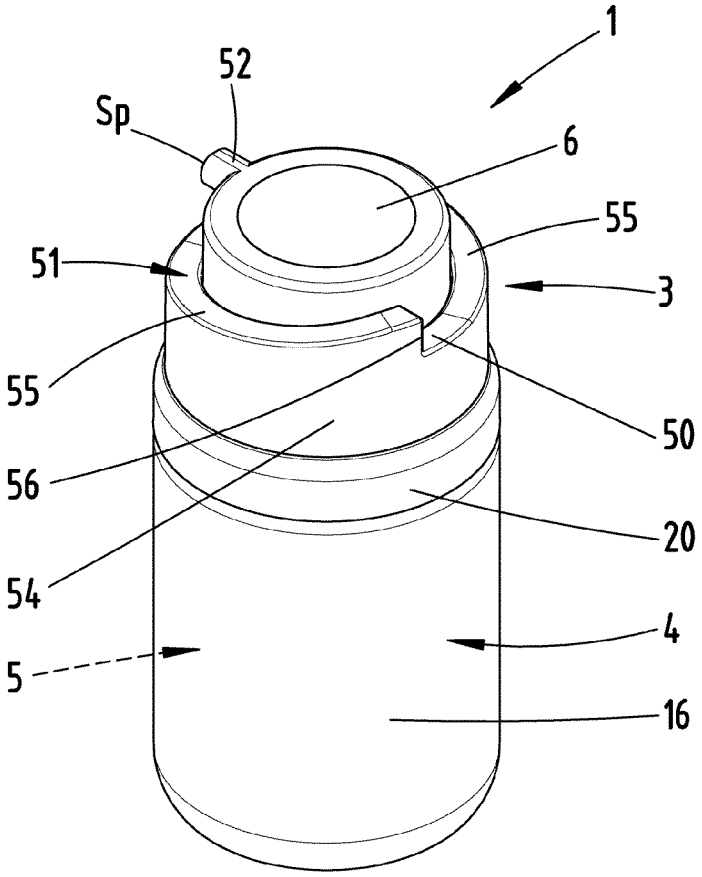
FIG. 1 a perspective view of a dispenser in the ready to use position.
Figure 2:
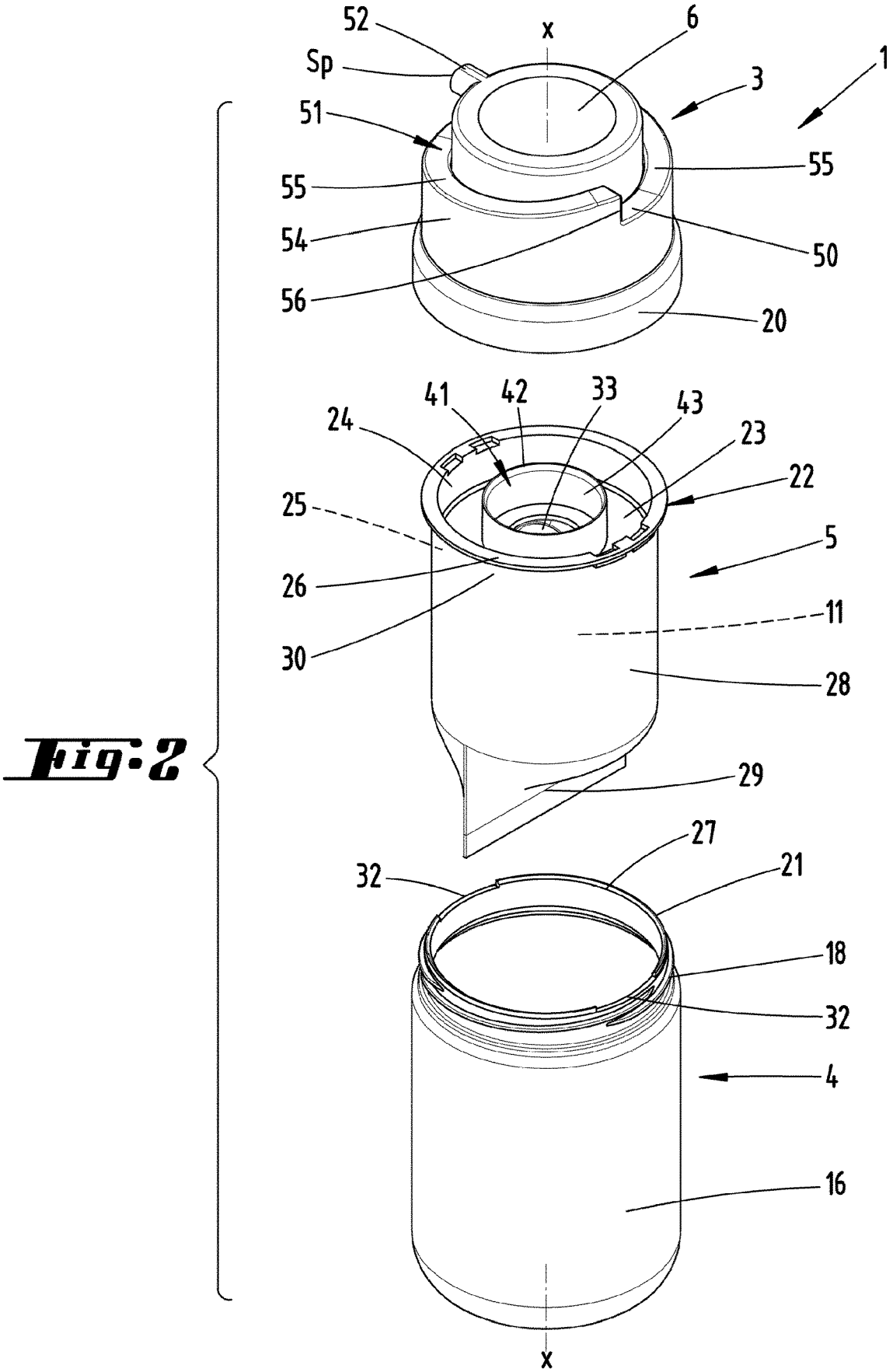
FIG. 2 a perspective exploded view of a dispenser head, an allocatable storage chamber part and a dispenser lower part.
Figure 3:
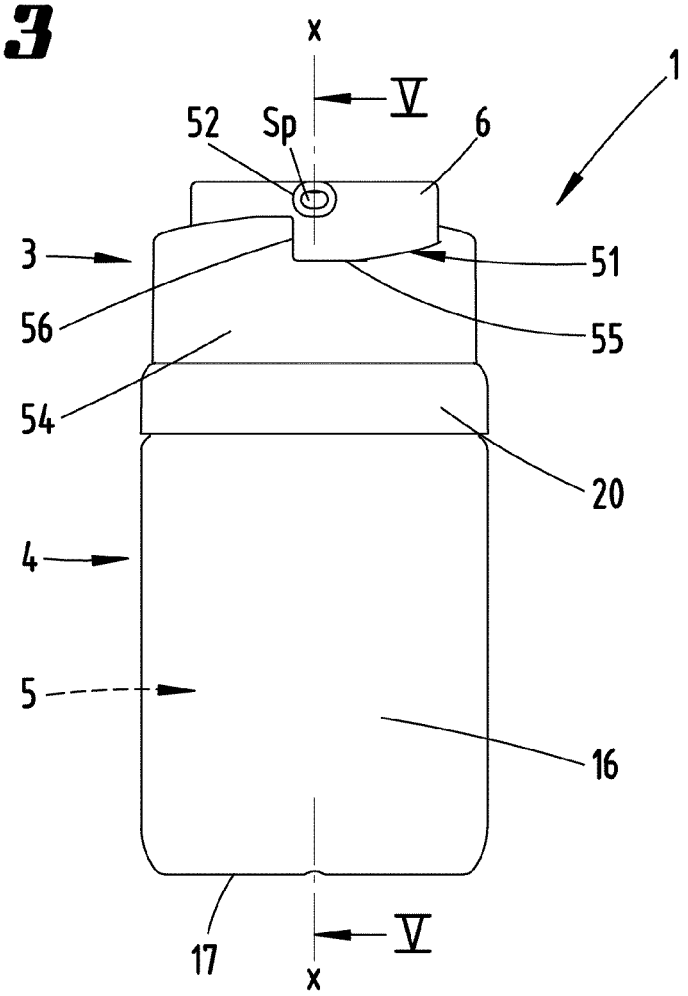
FIG. 3 a side view of the dispenser.
Figure 4:
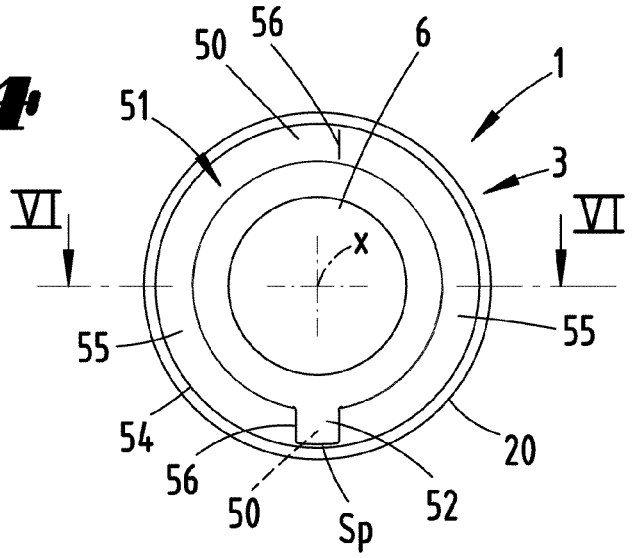
FIG. 4 a top view of the dispenser.
Figure 5:
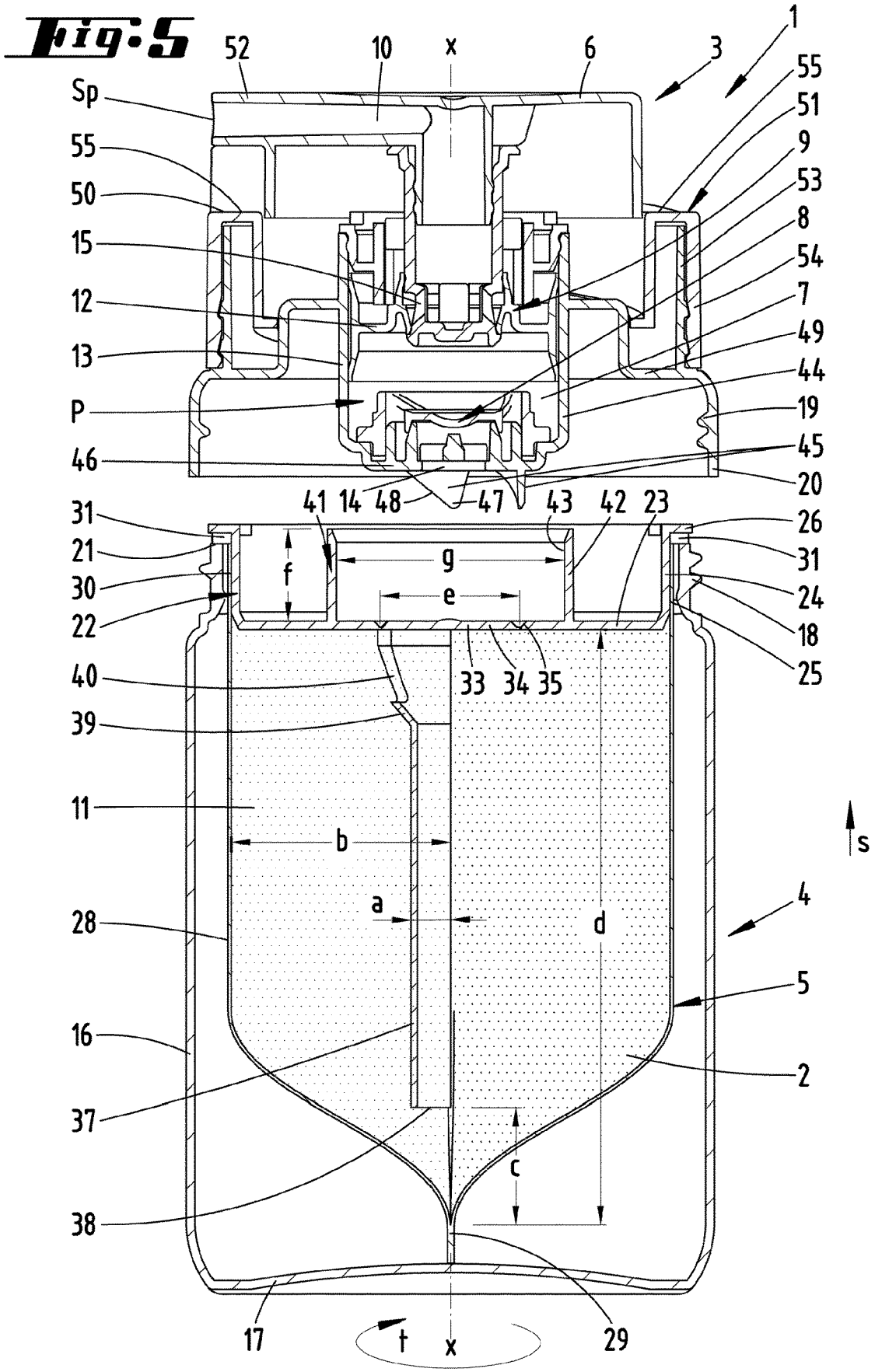
FIG. 5 the section according to line V-V on FIG. 3, an intermediate position when attaching the dispenser lower part provided with the storage chamber part to the dispenser head.

As evident from the view on FIG. 2, for example, the dispenser 1 is essentially comprised of a dispenser head 3 and a dispenser lower part 4, which receives a baglike storage chamber part 5 in a replaceable manner.

The dispenser head 3 can be a conventional pump dispenser, in which, in order to dispense a portion of the compound 2, the user manually performs a preferably linear displacement of a pump head 6, preferably along a central middle axis x of the dispenser 1. In such a pump motion of the pump head 6, compound is conveyed out of a pump chamber 7, which can be bordered by an input valve 8 on the one hand and an output valve 9 on the other, via the output valve 9 hereby opened through an output channel 10 and a dispenser opening Sp formed on the end side of the output channel 10 (see FIG. 12). As the pump head 6 is displaced back into the initial position, for example as shown on FIGS. 5 and 13, compound is siphoned out of the storage chamber 11 of the storage chamber part 5 and into the pump chamber 7 via the then open input valve 8. The output valve 9 is here closed.

The pump chamber 7 as well as the input valve 8 along with the output valve 9 are essentially components of a dispenser head-side pumping arrangement P. During each pump motion, a pump piston 12 sealed against a chamber wall 13 moves in the pump chamber 7. It is fastened to the pump head 6.

The input valve 8 seals a chamber entry opening 14. As the pump is downwardly displaced in the displacement direction r of the pump head 6 or of the pump piston 12, the output valve 9 releases passage openings 15 for the passage of compound 2 out of the pump chamber 7 into the output channel 10. A stroke h here arises along the middle axis x, wherein the dimension of the stroke h is crucial for the portion size of the compound 2 to be dispensed.

The storage chamber part 5 can preferably be received in the dispenser lower part 4 in a replaceable manner. Further preferred in this regard is a plug-in suspension bracket of the storage chamber part 5 in the dispenser lower part 4. In this regard, however, a screw connection or a bayonet type connection can be involved. In any event, it is further preferred in this regard that an allocation that can be lifted without tools be involved.

The dispenser lower part 4 is preferably shaped like a pot, further preferably designed rotationally symmetrically to the middle axis x, as also provided in relation to the essential components of the dispenser head 3. This yields a circumferential lower part wall 16 and a lower part floor 17 that runs essentially transverse to the middle axis x.

A radially outwardly facing thread formation that in the ready to use position of the dispenser 1 is in threaded engagement with an allocated mating thread 19 of the dispenser head 3 is provided in the area of the free end of the lower part wall 16 that faces upwardly, for example when the dispenser 1 is placed on an even surface. As also preferred, the mating thread 19 can here be formed in the area of a collar 20 that overlays the threaded formation 18 of the dispenser lower part 4 (see FIGS. 6 and 7).

The free frontal edge surface of the circumferential lower part wall 16 forms a support surface 21 for an adapter part 22 of the storage chamber part 5.

The adapter part 22 is preferably a plastic injection molded part, further preferably having a pot-like or hollow cylindrical design overall. A cylinder floor 23 that is preferably and essentially aligned at a right angle to the middle axis x initially arises in the allocation position in the dispenser lower part 4, from which a cylinder section 24 with an outer cylinder surface 25 that is preferably aligned at a right angle to the cylinder floor 23, and further preferably runs concentrically to the middle axis x, proceeds circumferentially on the edge side.

On the end side facing away from the cylinder floor 23, the cylinder section 24 preferably transitions into a radially outwardly protruding support collar 26, whose radial dimension beyond the outer cylinder surface 25 is preferably selected in such a way as to enable a support on the support surface 21 of the dispenser lower part 4 over at least approximately the full surface. In the allocation position, for example as shown on FIG. 6, the support collar 26 of the adapter 22 is supported on the support surface 21 of the dispenser lower part 4, wherein the overall cylindrical, pot-like formation of the adapter part 22 protrudes through the lower part opening 27 in the direction toward the interior of the dispenser lower part 4. The outer diameter in the area of the cylinder section 24 of the adapter part 22 is here adjusted to the diameter dimension of the lower part opening 27, here preferably leaving a radial clearance in the millimeter range, for example a clearance of 2 or 3 mm.

Figure 15:
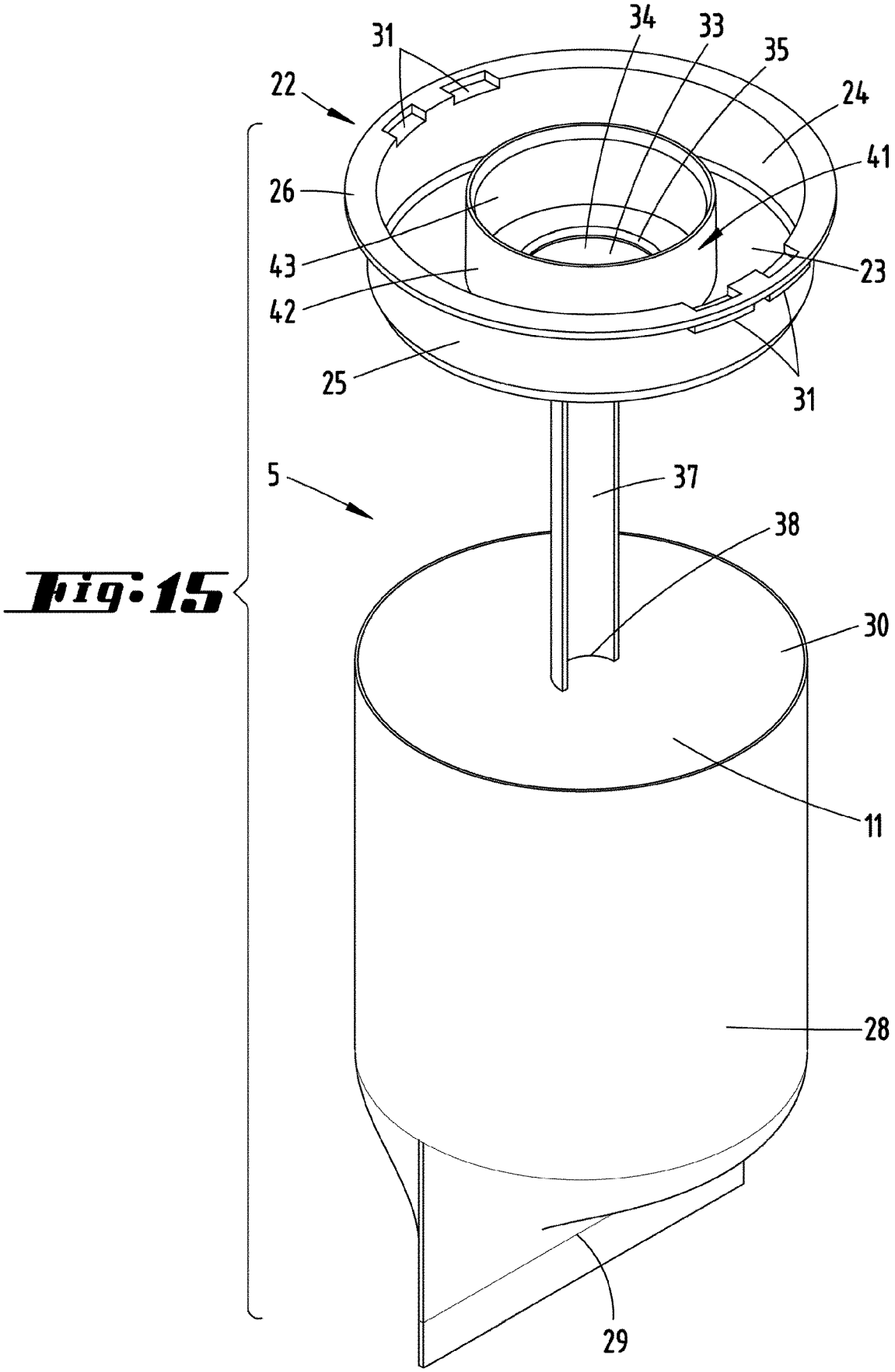
FIG. 15 a perspective exploded view of an adapter part and an allocatable film bag of the storage chamber part.
Figure 18:
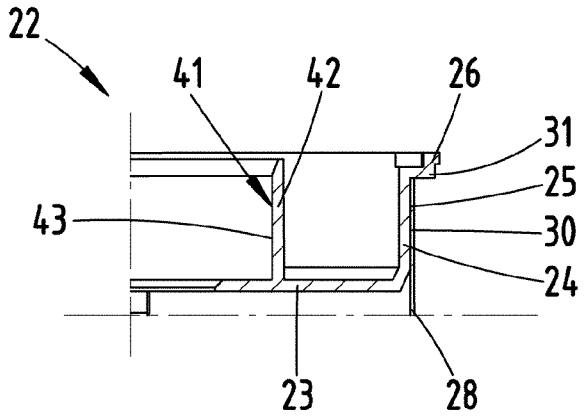
FIG. 18 the magnified section according to line XVIII-XVIII on FIG. 16.

A film bag 28 acts together with the adapter part 22 to form the storage chamber 11. As evident from the illustrations on FIGS. 2 and 15, for example, the film bag 28 can be designed as a hose section, wherein the area of one end of the hose is provided with a weld seam 29 in order to form the floor of the film bag 28.

The open edge area 30 of the film bag 28 facing away from the weld seam 29 is fixed to the outer cylinder surface 25 of the adapter part 22, for example and as also preferred, as the result of adhesive bonding or welding. In this regard, the cylinder floor 23 of the adapter part 22 forms a storage chamber cover.

The storage chamber part 5 is preferably received in the dispenser lower part 4 secured against rotation. As also preferred, a projection formation can be provided for this purpose in the area of the support collar 26 of the adapter part 22 for interacting with an allocated receptacle in the area of the support surface 21. As evident from FIG. 15, for example, projections 31 that are essentially and preferably arranged diametrically opposite each other can be formed on the underside of the support collar 26, and in the allocation position freely project downwardly beyond the collar surface resting on the support surface 21.

Figure 10:
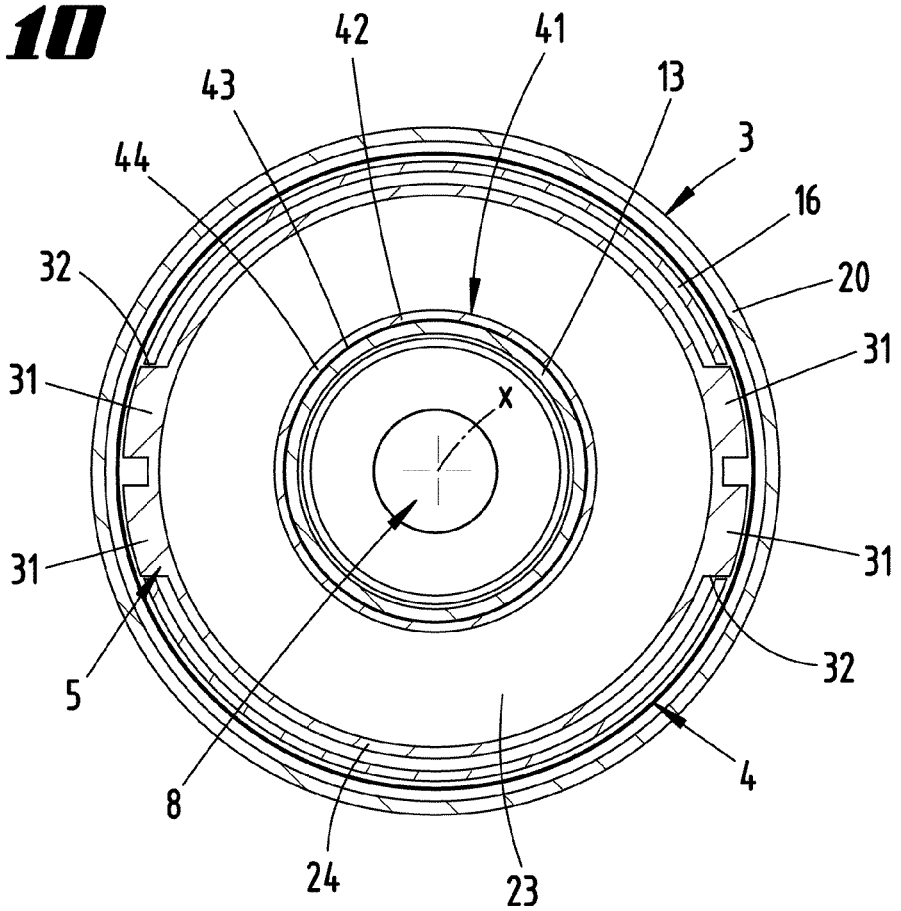
FIG. 10 the section according to line X-X on FIG. 6.

In the allocation position, these projections 31 engage into a recess 32 open at the edge in the area of the support surface 21 of the dispenser lower part 4. According to the arrangement of the projections 31, two diametrically opposing recesses 32 can preferably also be provided, wherein two projections 31 spaced apart from each other in the circumferential direction can further preferably be allocated to each recess 32 on the adapter part side (see also FIG. 10).

Given a proper allocation of the storage chamber part 5 in the dispenser lower part 4, this results in a bracket that is secured against rotation. In the proper use position, the storage chamber part 5 is connected with the dispenser lower part 4 secured against rotation.

Given a proper allocation of the storage chamber part 5 in the dispenser lower part 4, this results in a bracket that is secured against rotation. In the proper use position, the storage chamber part 5 is connected with the dispenser lower part 4 secured against rotation.

Figure 19:
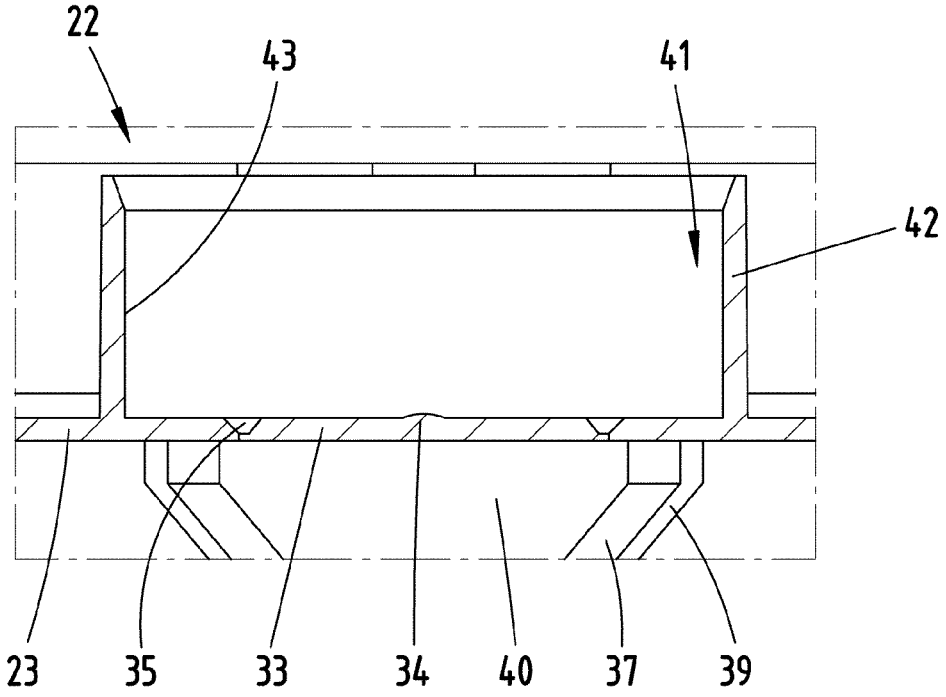
FIG. 19 the magnified area XIX on FIG. 17.

In the cylinder floor 23 of the adapter part 22, a cover element 33 has a one piece and materially uniform design, preferably centrally receiving the middle axis x. As also shown on the drawings, this cover element 33 is preferably designed as a plate part 34, with a circumferential, preferably completely circumferential weakened area 35 in the form of a depression that is wedge-shaped in a vertical section according to FIG. 6, with the middle axis x represented as a line in said vertical section (see also FIG. 19). Before assuming a ready to use position of the storage chamber part 5, for example in a stocked position prior to arrangement in the dispenser 1, the cover element 33 or the plate part 34 together with the surrounding cylinder floor 23 forms a closed storage chamber cover. Accordingly, the cover element 33 forms a seal of the storage chamber 11, wherein this seal can preferably only be broken on purpose by the user.

Figure 11:
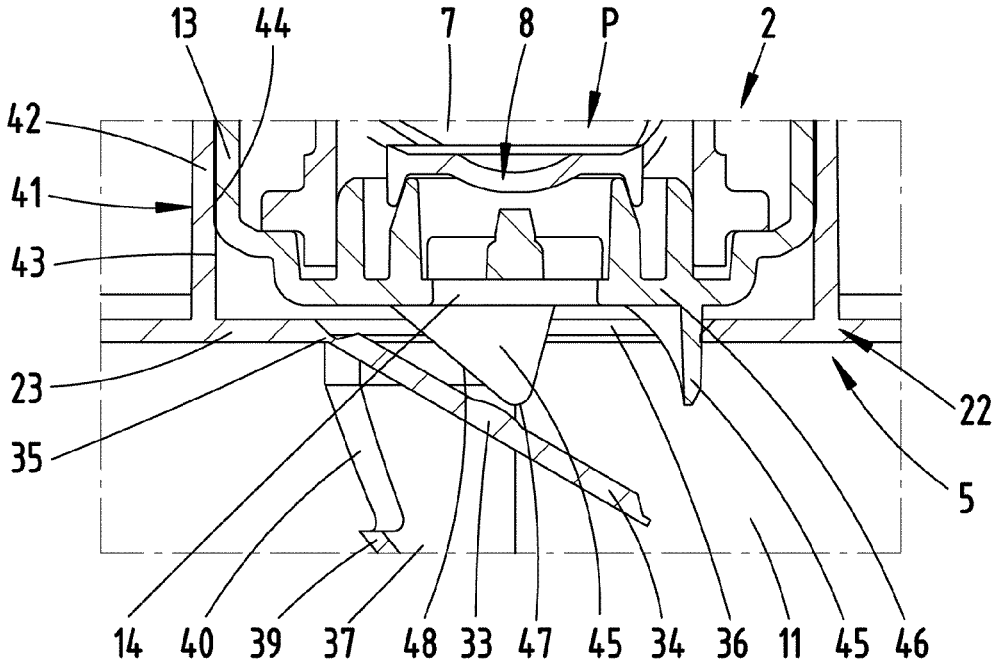
FIG. 11 the magnified area XI on FIG. 6.

In a usual position of use or ready to use position, the cover element 33 releases an opening 36 in the cylinder floor 23 of the adapter part 22, wherein compound 2 can be siphoned through this opening 36 out of the storage chamber 11 via the chamber entry opening 14 into the pump chamber 7 during a pump activation (for example, see FIG. 11).

A holding-open part 37 is preferably molded onto the cylinder floor 23 of the adapter part 22 as one piece and in a materially uniform manner on the bottom side, protruding into the storage chamber 11 spanned by the film bag 28. As also preferred, the latter can be designed as a tubular, rodlike part that is designed essentially concentrically to the middle axis x, further preferably as a half tube with a radial dimension a that can correspond to about one tenth to one third, further for example to about one fifth of the radial extension dimension b of the film bag 28 in the completely filled position according to FIG. 5. In addition, the radial dimension a of the holding-open part 37 can correspond to about 0.25 to 0.5 times, further to about 0.3 times the diameter dimension e of the arising opening 36 produced by the weakened area 35 (see also FIGS. 8 and 15 to 17).

Proceeding from the bottom side of the cylinder floor 23, the axial extension dimension of the holding-open part 37 can be selected in such a way that the free and open end 38 of the holding-open part 37 ends spaced apart by distance c from the weld seam 29. The distance dimension c can here correspond to about one sixth of the depth d of the film bag 28 viewed in the extension direction of the middle axis x, proceeding from the bottom side of the cylinder floor 23 up to the beginning of the weld seam 29 (see FIG. 5).

In the end area of the holding-open part 37 facing the cylinder floor 23, further corresponding to about one fourth or fifth of the axial extension length of the holding-open part 37, the holding-open part 37 is expanded like a funnel while essentially retaining the half-shell configuration, preferably to a radial dimension that can essentially correspond to half the diameter dimension e in the area of the opening 36. This yields a possible swing-in arm for the cover element 33 in the use position of the dispenser 1 (see FIG. 12).

In this expanded section 39 of the holding-open part 37, the wall of the holding-open part 37 is penetrated by a windowlike through hole 40, with this wall otherwise also having a closed design over its length, so as to favorably rinse the opening 36 with compound 2 from the storage chamber 11.

On the top side of the cylinder floor 23, correspondingly facing away from the storage chamber 11, a seal collar 41 is preferably formed in a materially uniform and one-piece manner with the cylinder floor 23 and the cylinder section 24. The seal collar 41 has a cylindrical seal wall 42, which is preferably aligned concentrically to the middle axis x, and hence further preferably concentrically to the cylinder section 24. The seal wall 42 preferably forms a cylindrical seal surface 43 on the inside, wherein the seal wall 42 can proceed from the surface of the cylinder floor 23 over about the axial extension dimension of the cylinder section 24 that surrounds the seal wall 42 with a radial distance.

Even in relation to the seal surface 43, the seal collar 41 that is outwardly open like a pot also extends over a height f viewed in the axial direction that can correspond to about 0.3 to 0.5 times, further to about 0.4 times the inner diameter g of the seal collar 41 in the area of the seal surface 43. This diameter g of the seal surface 43 can further correspond to about 1.5 to 2.5 times, further preferably to about 2 times the resultant opening diameter e.

The seal surface 43 serves to interact in a sealing manner with a preferably outer counter-seal surface 44 of the dispenser head-side chamber wall 13. Accordingly, the inner diameter g of the seal surface 43 is preferably adjusted to the outer diameter of the chamber wall 13.

The dispenser lower part 4 provided with the storage chamber part 5 is attached to the dispenser head 3 in an attachment direction s (see FIG. 5) in the extension direction of the middle axis x. The dispenser lower part 4 with the storage chamber part 5 is here fixed to the dispenser head 3 while performing a screwing motion (symbolically denoted on FIG. 5 by the arrow t), taking a thread engagement between the thread formation 18 of the dispenser lower part 4 and the mating thread 19 on the dispenser head 3.

Figure 6:
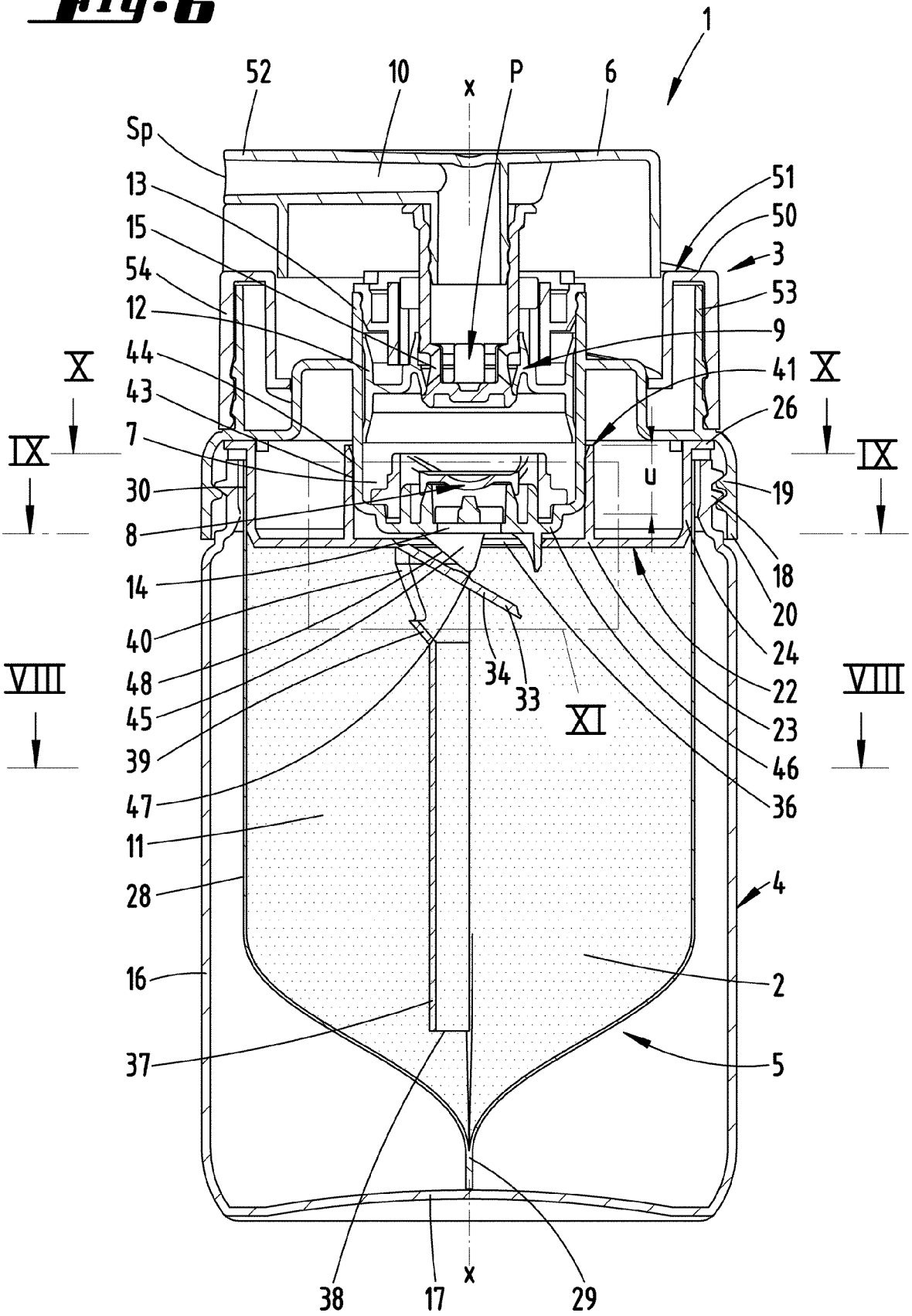
FIG. 6 a view essentially corresponding to FIG. 5, but relating to a ready position of the dispenser prior to a first use.
Figure 7:
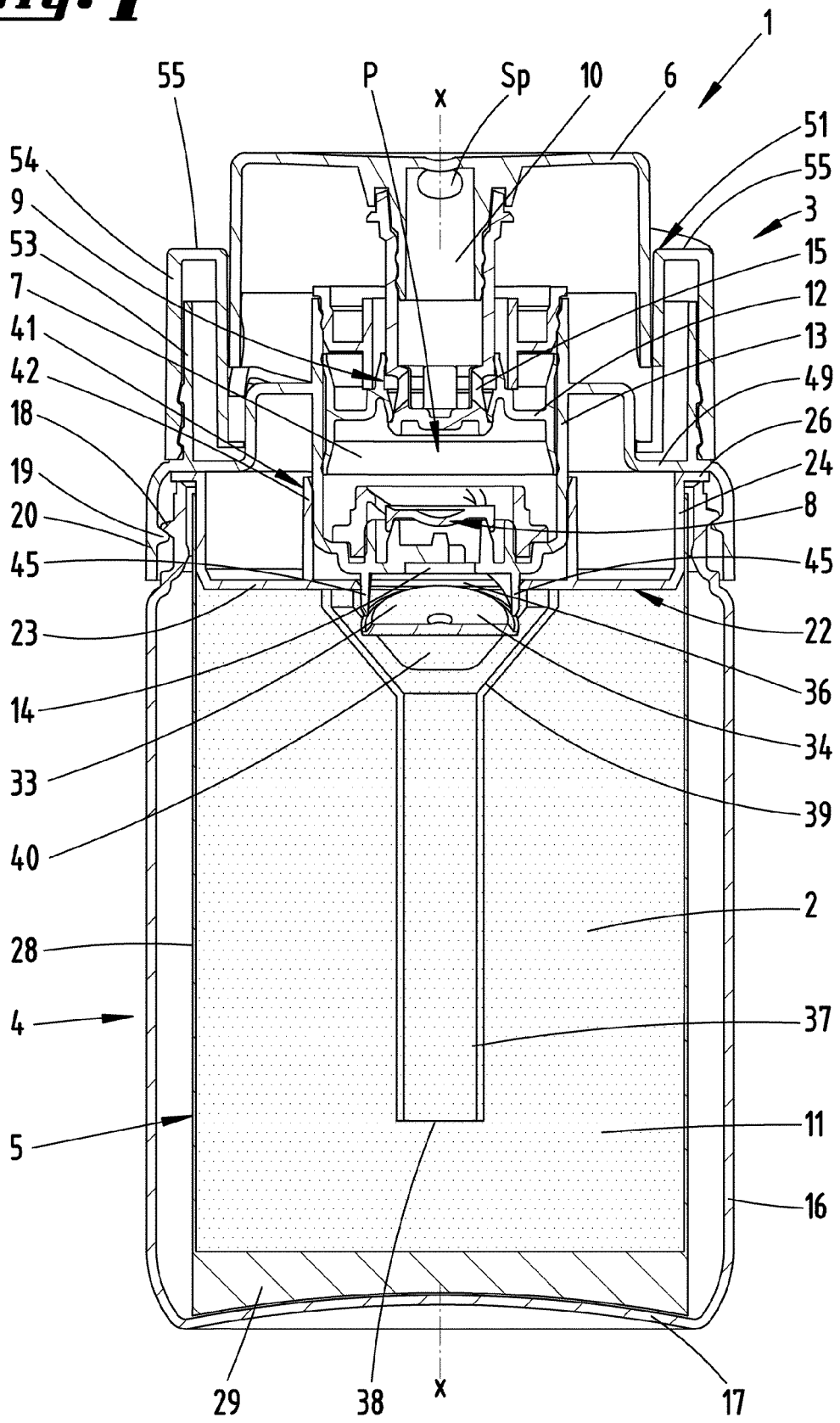
FIG. 7 the section according to line VII-VII on FIG. 4, relating to the ready position according to FIG. 6.
Figure 8:
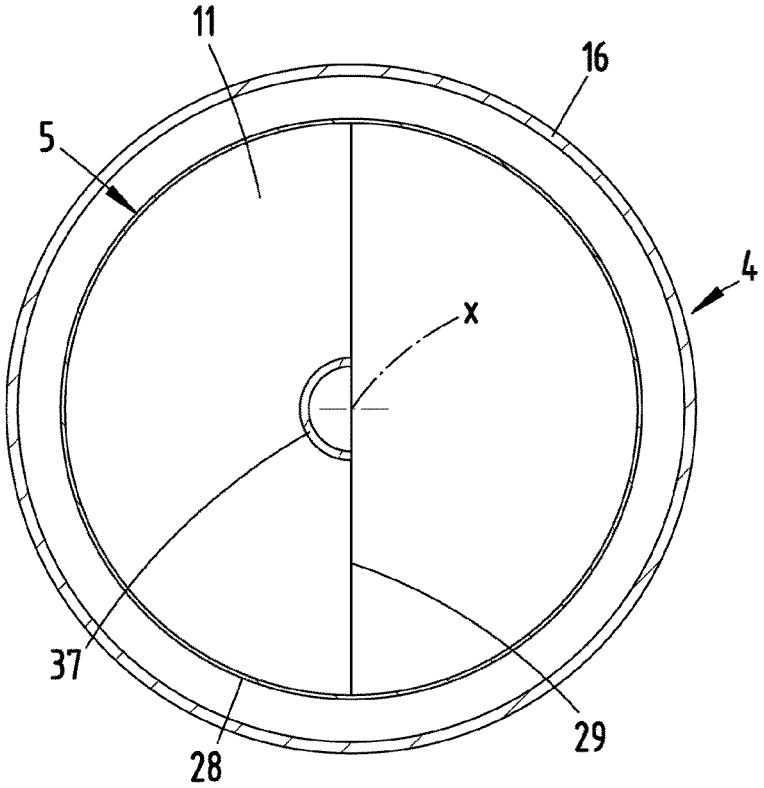
FIG. 8 the section according to line VIII-VIII on FIG. 6.
Figure 9:
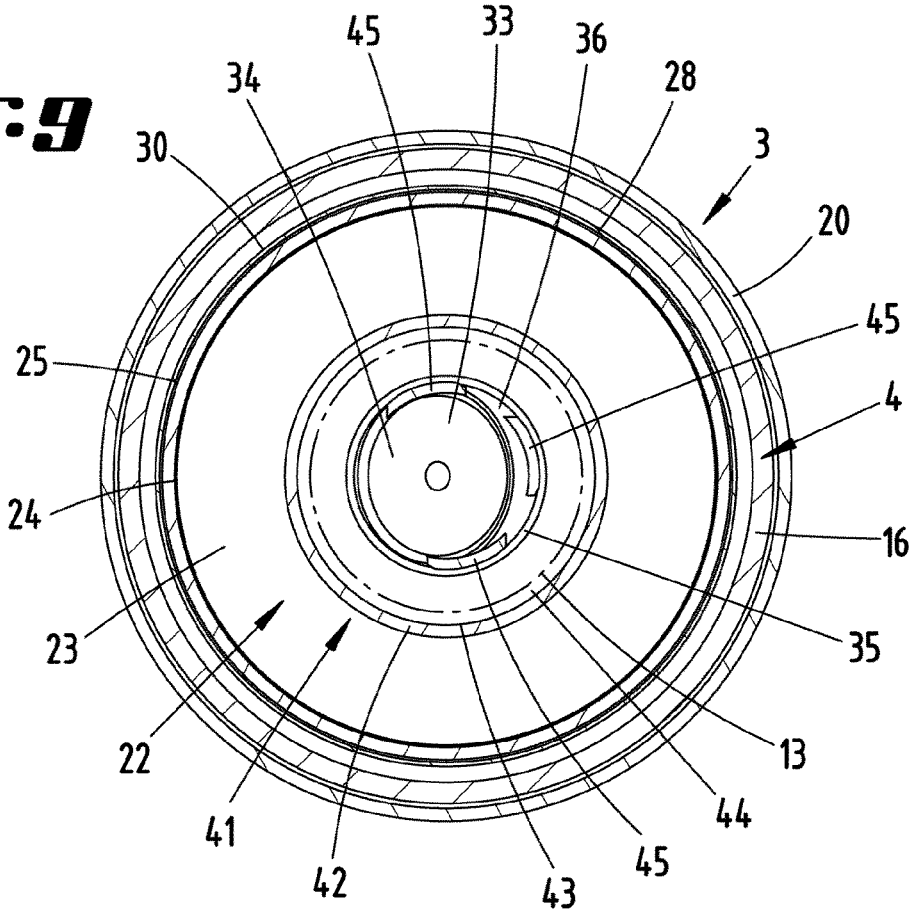
FIG. 9 the section according to line IX-IX on FIG. 6.
Figure 14:
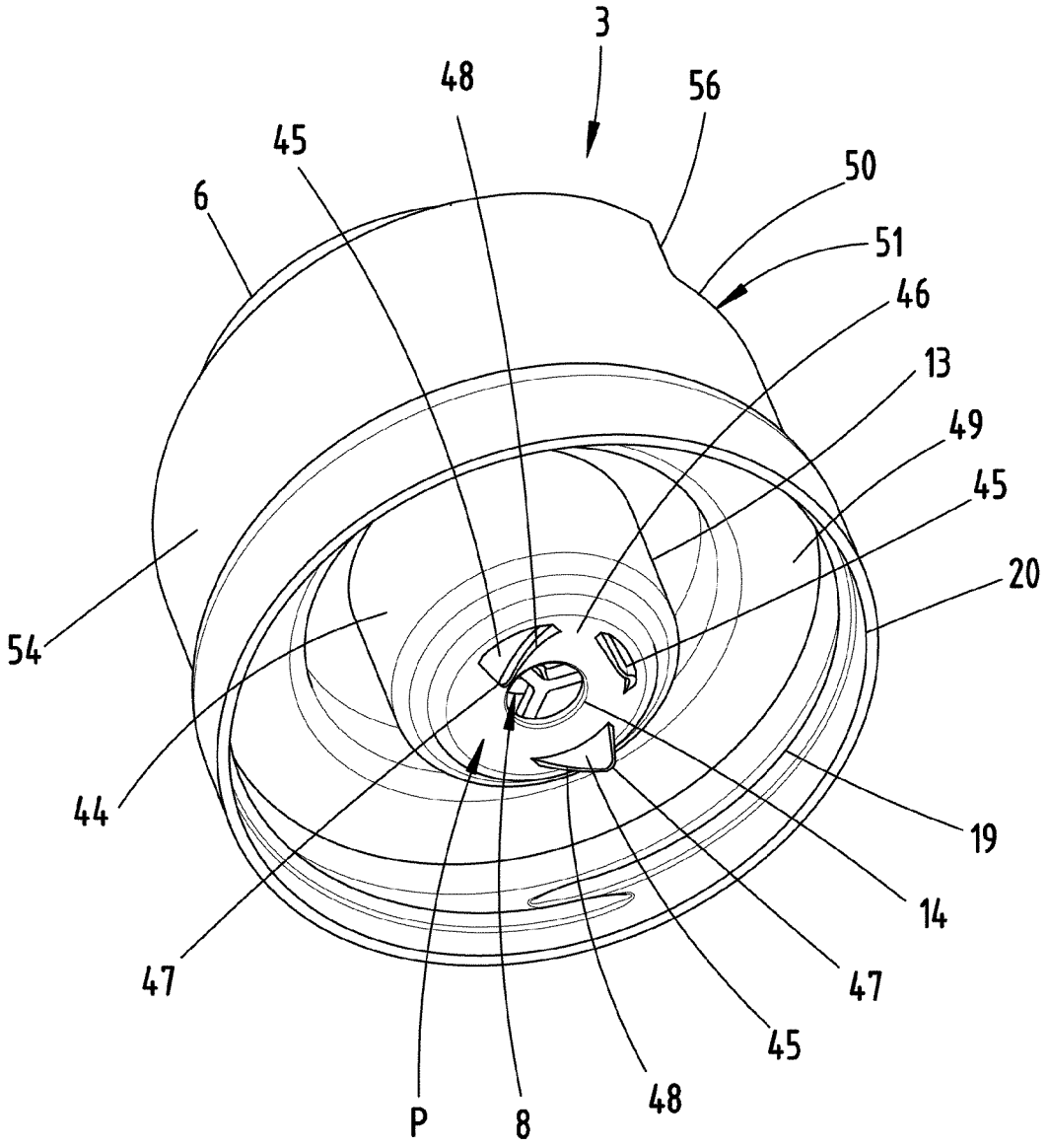
FIG. 14 a perspective bottom view of the dispenser head.

During this attachment process and with the storage chamber part 5 still sealed, the cover element 33 or the plate part 34 is moved by corresponding opening means 45 on the dispenser head 3 into a position that releases the opening 36 (see FIG. 6). These opening means 45 are preferably arranged underneath the pump chamber 7 in the area of a chamber floor 46 having the chamber entry opening 14, and further preferably designed as one piece and in a materially uniform manner with the chamber wall 13 and the chamber floor 46. As also shown, for example, in a plan view in which the middle axis x is represented as a point, three swordlike opening means 45 arranged offset relative to each other in a circumferential direction by about 90 degrees can be involved, which overall can extend essentially over a circumferential angle range of about 270 to 300 degrees (see also FIGS. 9 and 14).

Each opening means 45 can have roughly a triangular design in relation to a projection in a vertical surface in which the middle axis x is represented as a line, with an opening means tip 47 that points downwardly in the direction toward the storage chamber 11 in the usual position of use. In particular these tips 47 are arranged on a circumferential line, which is preferably adjusted to the circumferential line of the weakened area 35 that surrounds the cover element 33. Accordingly, while the dispenser lower part 4 is being attached to the dispenser head 3, the weakened area 35 is loaded by the opening means 45, in particular their tips 47, in an axial direction and for this purpose is overlapped in a rotational direction, so as to achieve a tearing along the weakened area 35 representing a desired tear line. The cover element 33 or plate part 34 can here become completely torn off. By contrast, in an embodiment that is preferred and also shown, the weakened area 35 is not destroyed completely by the opening means 45, but for example rather only over a circumferential partial area of preferably more than 300 degrees up to 330 or 340 degrees, for example, so that the cover element 33 hereafter continues to hang on the cylinder floor 33 like a film hinge. One or several opening means 45 can here load the cover element 43 by correspondingly having an opening means edge 48 impinge upon the cover element surface in such a way as to hold the cover element 43 in the position that releases the opening 36, for example as shown on FIG. 6. The compound 2 that flows through the through hole 40 during a pump activation can in this way also not cause the cover element 33 to be displaced back into a position that closes the opening 36.

The destruction of the weakened area 35 while screwing the dispenser lower part 4 to the dispenser head 3 is ensured by virtue of the fact that the storage chamber part 5 is received in the dispenser lower part 4 secured against rotation.

In the ready to use position according to FIG. 6, for example, the seal surface 43 of the seal section 41 and the counter-seal surface 44 of the chamber wall 13 act over a height u viewed in the axial direction that can correspond to about 0.5 to 0.75 times, further to about 0.6 times the seal surface height f, for example.

In addition, in this ready to use position, the support collar 26 of the storage chamber part 5 is caught between the support surface 21 of the dispenser lower part 4 and a pot collar 49 of the dispenser head 3 that carries the collar 20 with the mating thread 19 and runs essentially transverse to the middle axis x. In addition to being secured in the circumferential direction, the storage chamber part 5 is in this way also fixed in the axial direction in this ready to use position.

In order to execute a pumping process, the pump head 6 can be pressed down in the direction of the middle axis x, preferably against a stop 50, which in the exemplary embodiment shown can essentially be formed by a slotted link path 51 that can be turned around the middle axis x, against which a projection 52 that protrudes radially outward on the pump head 6 can come to a stop.

A pot wall 53 that is concentrically circumferential to the middle axis x can further be molded onto the pot collar 49 of the dispenser head 3, and can offer a fastening collar for a rotating part 54. The rotating part 54 is mounted to the pot wall 53 so that it can rotate around the middle axis x relative to the pot wall 53, and in addition also relative to the pump chamber 7 or the pump device P, but cannot be displaced in the axial direction.

The outer circumferential wall of the rotating part 54 can transition into a cover that essentially extends in a plane perpendicular to the middle axis x and projects radially inwardly, which can essentially be formed by the slotted link path 51.

The slotted link path 51 can essentially be comprised of two helical surfaces 55 that follow each other in the circumferential direction. Each helical surface 55 preferably extends by 180 degrees in the circumferential direction, wherein a respective vertical step 56 can be formed in the circumferential direction between the helical surfaces 55. The pitch angle of each helical surface 55 can measure about 10 degrees to 20 degrees, further for example about 15 degrees.

By twisting the rotating part 54 around the middle axis x, and hence concurrently displacing the helical surfaces 55 that comprise the stop 50 for the projection relative to the projection 52 that is fixed by contrast, a change in the stroke dimension h can be made, so that the maximum output quantity of compound 2 can also be set accordingly by turning the rotating part 54.

After a compound has been discharged by pressing down the pump head 6, the latter can be manually displaced back into the initial position via the rotating part 54 through an interaction between a helical surface 55 and the projection 52. In this regard, however, a restoring spring can alternatively be arranged in the dispenser head 3 in order to reset the pump head 6.

In a preferred embodiment, the projection 52 that interacts with the slotted link path 51 is a partial section of the output channel 10 that has the dispenser opening Sp.

Figure 12:
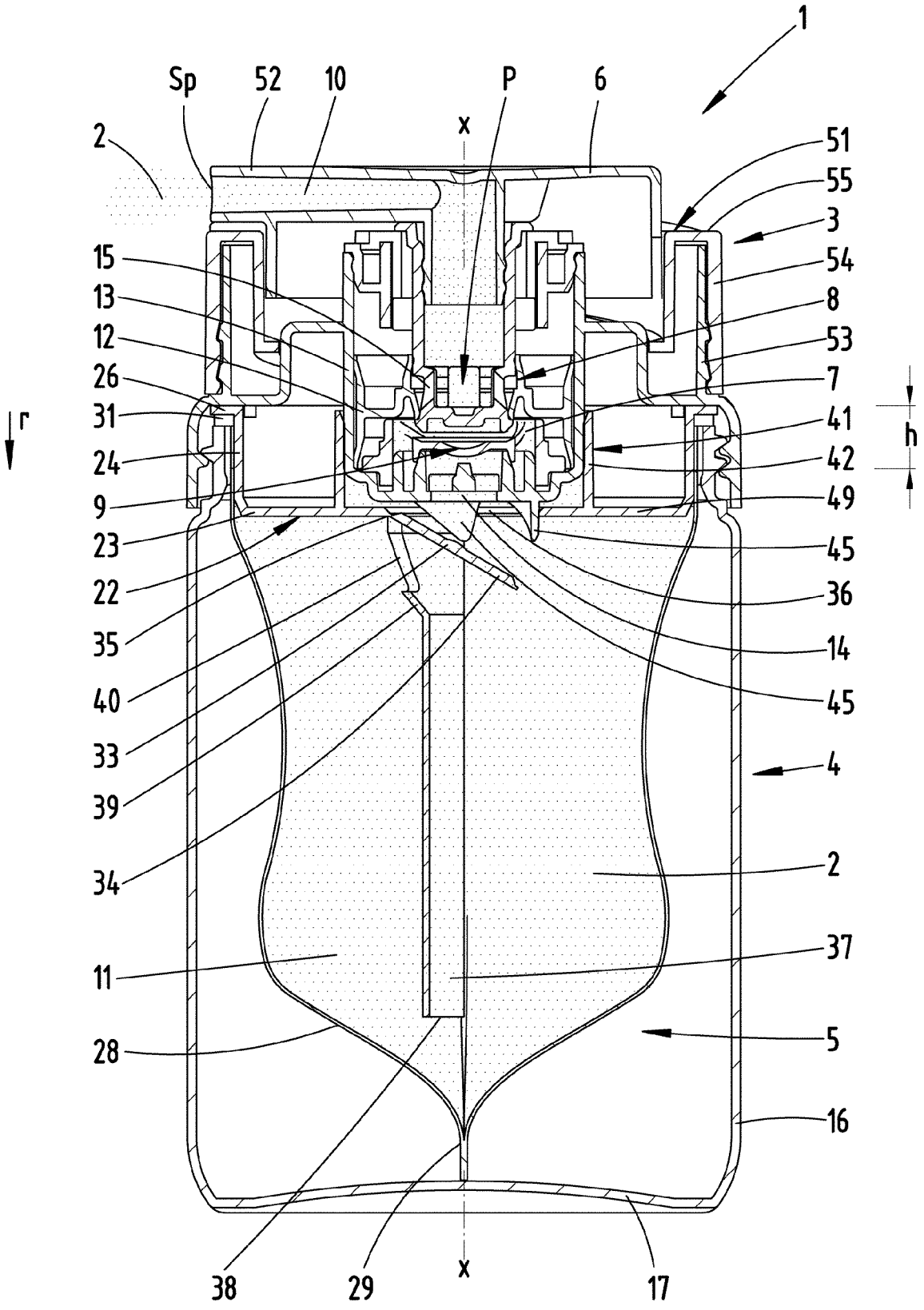
FIG. 12 a sectional view essentially corresponding to FIG. 6, but relating to a dispensing position of the dispenser.
Figure 13:
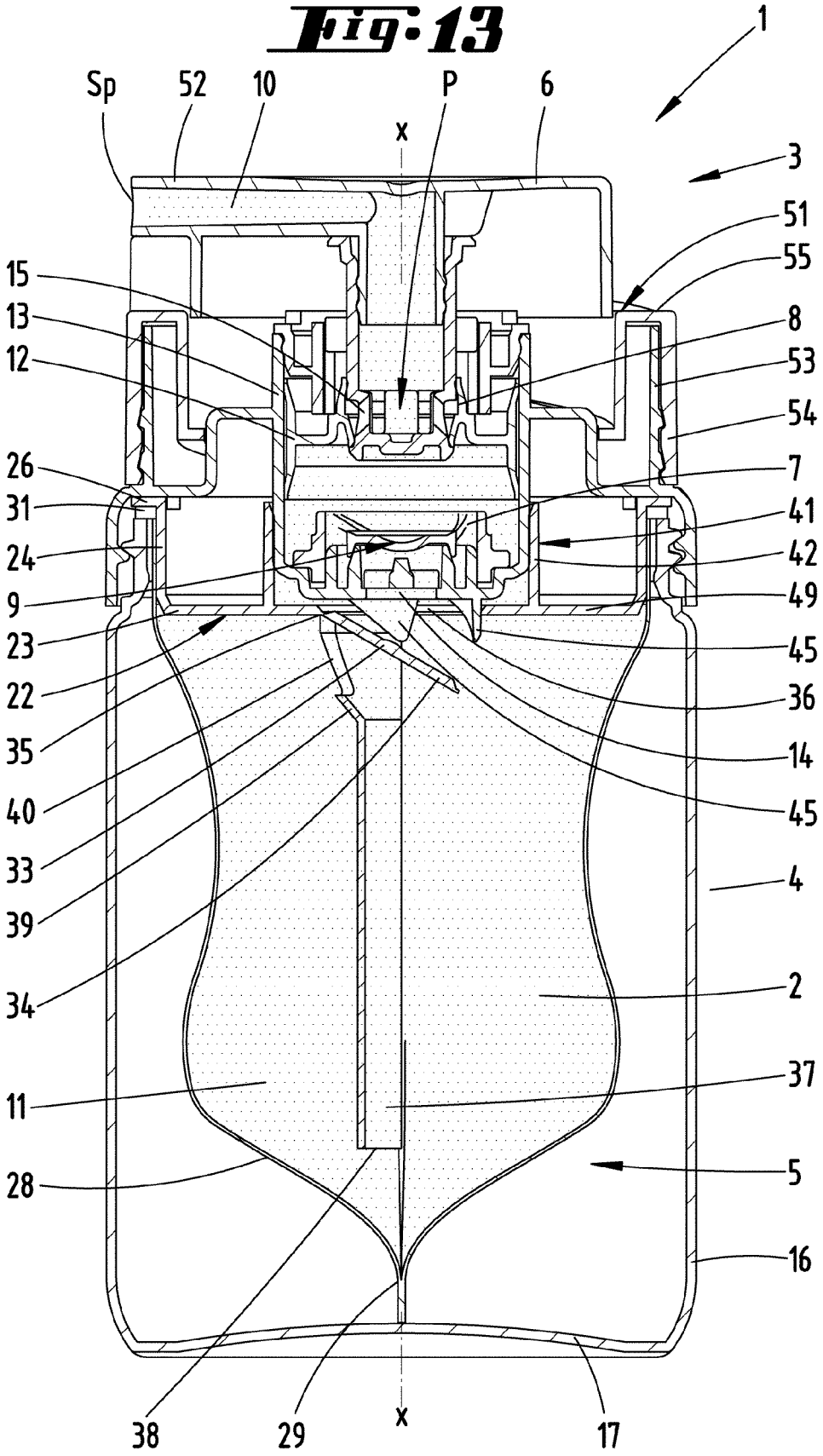
FIG. 13 a follow-up to FIG. 12, relating to a nonuse position of the dispenser after a dispensing of compound.

As evident from the illustrations on FIGS. 12 and 13, the film bag 28 tends to be compressed in the direction of the middle axis x during a successive evacuation of the storage chamber 11. In order to correspondingly equalize the pressure in the dispenser lower part 4, air is sucked in via the thread—which is non-sealing in this regard—between the dispenser lower part 4 and the dispenser head 3 during a dispensing process.

In order to prevent wall areas of the film bag 28 from adhering to each other during the successive evacuation of the storage chamber 11, the holding-open part 37 is provided, which ensures a minimum distance between the wall areas, and hence a preferred complete evacuation of the baglike storage chamber 11.

The molded parts of the dispenser 1, such as in particular the dispenser lower part 4, the adapter part 22, and the parts of the dispenser head 3, for example also the rotating part 54 with the slotted link path 51, can consist predominantly of a plastic material, for example such as polyethylene, and are preferably manufactured in an injection molding process. Valves can be major exceptions, and can possibly consist of a rubbery material, which can also be a TPE (and to this extent can also find application in the injection molding process).

The above statements serve to describe the inventions encompassed by the application as a whole, which further develop prior art at least via the following feature combinations, and also each taken separately, wherein two, several, or all of these feature combinations can also be combined, specifically:

An adapter part 22, characterized by a cover element 33 which can be acted upon in order to form an opening 36, and a seal wall 42 that circumferentially extends to the cover element 33, which is suitable to interact with the dispenser in a sealing manner.

An adapter part 22, characterized by a cylinder section 24, the outer cylinder surface 25 of which is provided for connection with a container part of the storage chamber 11.

An adapter part 22, characterized in that the outer cylinder surface 25 transitions into a cylinder floor 23 that runs at essentially a right angle to the outer cylinder surface 25.

An adapter part 22, characterized in that the seal wall 42 extends at essentially a right angle to the cylinder floor 23.

An adapter part 22, characterized in that a holding-open part 37 provided to protrude into the storage chamber 11 is attached to the adapter part 22.

An adapter part 22, characterized in that the cover element 33 is designed as a film.

An adapter part 22, characterized in that the cover element 33 is formed by a plate part 34 that has a circumferential weakened area 35.

An adapter part 22, characterized in that the plate part 34 transitions into a surrounding area of the adapter part 22 in a materially uniform manner via the weakened area 35.

A dispenser, characterized in that the pump device P has an opening means 45 on the storage chamber side for automatically acting on the cover element 33 in order to form the opening 36 when the storage chamber part is placed on the dispenser head 3.

A dispenser, characterized in that the adapter part 22 has a seal collar 41 for connection to the pump device P in a sealing manner.

A dispenser, characterized in that the seal collar 41 has a seal surface 43, which extends essentially in an attachment direction s of the storage chamber part 5 on the pump device P.

A dispenser, characterized in that the storage chamber part 5 can be attached to the pump device P during a screwing motion t.

A dispenser, characterized in that the storage chamber part 5 is received in the dispenser lower part 4.

A dispenser, characterized in that the dispenser lower part 4 has a thread formation 18 for interacting with the dispenser head 3.

A dispenser, characterized in that the storage chamber part 5 is received in the dispenser lower part 4 secured against rotation.

A dispenser, characterized in that the adapter part 22 for giving the storage chamber part 5 a baglike design is connected with a film bag 28 for receiving the compound 2.

A dispenser, characterized in that the adapter part 22 has a cylinder section 24, the outer cylinder surface 25 of which is connected with an edge area 30 of the film bag 28.

A dispenser, characterized in that the outer cylinder surface 25 transitions into a cylinder floor 23 that runs at essentially a right angle to the outer cylinder surface 25.

A dispenser, characterized in that the seal surface 43 that runs at essentially a right angle to the cylinder floor 23 adjoins the cylinder floor 23, and is outwardly directed relative to the storage chamber 11.

A dispenser, characterized in that a holding-open part 37 that protrudes into the interior of the storage chamber 11 is attached to the adapter part 22.

A dispenser, characterized in that the cover element 33 is designed as a film.

A dispenser, characterized in that the cover element 33 is formed by a plate part 34 that has a circumferential weakened area 35.

A dispenser, characterized in that the plate part 34 transitions into a surrounding area of the adapter part 22 in a materially uniform manner via the weakened area 35.

A dispenser, characterized in that the opening means 45 interacts with the weakened area 35 or the film in a destructive manner.

A storage chamber, characterized in that the seal collar 41 runs so as to surround the cover element 33 in the form of a closed circumferential cylindrical seal wall.

A storage chamber, characterized in that the adapter part 22 for giving the storage chamber part 5 a baglike design is connected with a film bag 28 for receiving the compound 2.

A storage chamber, characterized in that the adapter part 22 has a cylinder section 24, the outer cylinder surface 25 of which is connected with an edge area 30 of the film bag 28.

A storage chamber, characterized in that the outer cylinder surface 25 transitions into a cylinder floor 23 that runs at essentially a right angle to the outer cylinder surface 25.

A storage chamber, characterized in that a seal surface 43 that runs at essentially a right angle to the cylinder floor 23 adjoins the cylinder floor 23, and is outwardly directed relative to the storage chamber 11.

A storage chamber, characterized in that a holding-open part 37 that protrudes into the interior of the storage chamber 11 is attached to the adapter part 22.

A storage chamber, characterized in that the cover element 33 is designed as a film.

A storage chamber, characterized in that the cover element 33 is formed by a plate part 34 that has a circumferential weakened area 35.

A storage chamber, characterized in that the plate part 34 transitions into a surrounding area of the adapter part 22 in a materially unform manner via the weakened area 35.

All disclosed features (whether taken separately or in combination with each other) are essential to the invention. The disclosure of the application hereby also incorporates the disclosure content of the accompanying/attached priority documents (copy of the prior application) in its entirety, also for the purpose of including features of these documents in claims of the present application. Even without the features of a referenced claim, the subclaims characterize standalone inventive further developments of prior art with their features, in particular so as to submit partial applications based upon these claims. The invention indicated in each claim can additionally have one or several of the features indicated in the above description, in particular those provided with reference numbers and/or indicated on the reference list. The invention also relates to design forms in which individual features specified in the above description are not realized, in particular if they are recognizably superfluous with regard to the respective intended use, or can be replaced by other technically equivalent means.

REFERENCE LIST

1 Dispenser
2 Compound
3 Dispenser head
4 Dispenser lower part
5 Storage chamber part
6 Pump head
7 Pump chamber
8 Input valve
9 Output valve
10 Output channel
11 Storage chamber
12 Pump piston
13 Chamber wall
14 Chamber entry opening
15 Passage opening
16 Lower part wall
17 Lower part floor
18 Thread formation
19 Matching thread
20 Collar
21 Support surface
22 Adapter part
23 Cylinder floor
24 Cylinder section
25 Outer cylinder surface
26 Support collar
27 Lower part opening
28 Film bag
29 Weld seam
30 Edge area
31 Projection
32 Recess
33 Cover element
34 Plate part
35 Weakened area
36 Opening
37 Holding-open part
38 Open end
39 Expanded section
40 Through hole
41 Seal collar
42 Seal wall
43 Seal surface
44 Counter-seal surface
45 Opening means
46 Chamber floor
47 Opening means tip
48 Opening means edge
49 Pot collar
50 Stop
51 Slotted link path
52 Projection
53 Pot wall
54 Rotating part
55 Helical surface
56 Vertical step
a Radial dimension
b Radial dimension
c Distance dimension
d Depth
e Diameter
f Height
g Diameter
h Stroke dimension
r Displacement direction
s Attachment direction
t Screwing motion
u Height
x Middle axis
P Pump device
Sp Dispensing opening

The invention claimed is:

1. An adapter part configured for arrangement in a passage to a storage chamber of a dispenser, comprising:

a cover element that is configured to be acted upon in order to form an opening, a seal wall that circumferentially extends to the cover element, the seal wall being configured to interact with the dispenser in a sealing manner, and a cylinder section, an outer cylinder surface of which is provided for connection with a container part of the storage chamber, wherein the outer cylinder surface transitions into a cylinder floor that runs at essentially a right angle to the outer cylinder surface and/or the seal wall extends at essentially a right angle to the cylinder floor, wherein on a top side of the cylinder floor, facing away from the storage chamber, a seal collar is formed in one piece with the cylinder floor and the cylinder section.

2. The adapter part according to claim 1, wherein a holding-open part provided to protrude into the storage chamber is attached to the adapter part.

3. The adapter part according to claim 1, wherein the cover element is designed as a film and/or the cover element is formed by a plate part that has a circumferential weakened area, wherein the plate part transitions into a surrounding area of the adapter part in a materially uniform manner via the weakened area.

* * * * *